US006929021B2

(12) United States Patent
Cavenagh

(10) Patent No.: US 6,929,021 B2
(45) Date of Patent: Aug. 16, 2005

(54) INFLATION/DEFLATION VALVE FOR A BAG TO BE FILLED WITH AIR

(75) Inventor: Edward J. Cavenagh, Winnipeg (CA)

(73) Assignee: Syn-Tex Convertors Ltd., Winnipeg (CA)

( * ) Notice: Subject to any disclaimer, the term of this patent is extended or adjusted under 35 U.S.C. 154(b) by 316 days.

(21) Appl. No.: 10/175,350

(22) Filed: Jun. 20, 2002

(65) Prior Publication Data

US 2003/0234040 A1 Dec. 25, 2003

(51) Int. Cl.[7] ..... F16K 15/20

(52) U.S. Cl. ..... 137/223; 137/232; 251/149.4; 410/119

(58) Field of Search ..... 137/223, 232; 251/149.4, 149.5; 410/119, 125

(56) References Cited

U.S. PATENT DOCUMENTS

| | | | | | |
|---|---|---|---|---|---|
| 2,789,577 | A | * | 4/1957 | Hosking | 137/223 |
| 3,260,276 | A | * | 7/1966 | Stasiunas | 137/234.5 |
| 3,785,395 | A | * | 1/1974 | Andreasson | 137/223 |
| 3,808,981 | A | * | 5/1974 | Shaw | 410/119 |
| 3,903,915 | A | * | 9/1975 | Rosaz | 137/232 |
| 3,995,653 | A | * | 12/1976 | Mackal et al. | 137/223 |
| 4,073,389 | A | * | 2/1978 | Angarola et al. | 410/119 |
| 4,844,123 | A | * | 7/1989 | Wick | 251/149.5 |
| 5,082,244 | A | | 1/1992 | Krier et al. | |
| 5,111,838 | A | | 5/1992 | Langston | |
| 5,203,831 | A | * | 4/1993 | Lind et al. | 137/223 |
| 5,275,197 | A | | 1/1994 | Finell | |
| 5,667,195 | A | * | 9/1997 | McCormick | 251/149.5 |
| 5,839,488 | A | | 11/1998 | Peters | |

* cited by examiner

*Primary Examiner*—John Rivell
(74) *Attorney, Agent, or Firm*—Adrian D. Battison; Michael R. Williams; Ryan W. Dupuis

(57) ABSTRACT

An inflation/deflation valve for filling a dunnage bag with air includes a sleeve for insertion into an opening in a wall of the bag, a cap for covering the sleeve and threaded onto the sleeve and an inflation head for engaging the cap. A valve is mounted in the cap having a valve seat, a valve member moveable generally axially of the sleeve and a spring biasing the movement of the valve member in the axial direction toward the valve seat. The cap has mounting lugs on the base adjacent the bag arranged for engagement with co-operating slots of the inflation head in a bayonet fitting where the slots are shaped so that the head is cammed by the lugs in the slots to cause depression of an abutment surface of the valve member against the spring bias to open the valve. The removal of the cap allows rapid deflation of the bag for testing or reuse. The sleeve is mounted on the bag by a mounting flange attached to the sleeve at an inner end of the sleeve for engaging an inner surface of the bag wall and a separate locating ring for mounting on the sleeve for engaging an outer surface of the wall such that the sleeve is held in place in the opening by the mounting flange and the locating ring. The ring and the sleeve have a plurality of locating positions so as to define a plurality of different spaces between the flange and the ring for receiving different thicknesses of wall.

16 Claims, 4 Drawing Sheets

INFLATION/DEFLATION VALVE FOR A BAG TO BE FILLED WITH AIR

This invention relates to an inflation and deflation valve for use in filling a bag with air and is primarily but not exclusively directed to bags for use as dunnage bags.

BACKGROUND OF THE INVENTION

Dunnage bags are large bags for inflation with air so as to provide pressure against cargo during transportation to prevent movement of the cargo. The bags are provided in different dimensions for different situations. The bags can be manufactured from a number of paper plies with an inner air impervious liner or from a lined fabric as is well known to one skilled in the art. The paper products are generally manufactured for one time use and are deflated simply by slashing open the bag to release the air quickly and allow the bag to be pulled from its location to release the cargo for unloading.

It is proposed that bags manufactured from lined fabric can be reused on a number of occasions and thus require a valve which allows deflation of the bag rapidly but without slashing an opening in the bag.

In addition the use of a valve which rapidly allows deflation of the bag also provides the opportunity for inflating the bag prior to use to test its air tightness. One serious problem with the single use paper bags is that they are untested and thus have a relatively high failure rate which can be as much as thirty percent. If the bag fails during transport, the load may become loose and can shift with potential for significant damage. If the bag fails during loading, it is of course inconvenient to remove the failed bag and to replace it with a further bag. The pre-testing of the bags is therefore highly desirable and provides a significant sales advantage.

Valves used simply for rapid inflation require simply a valve stem with an inflation head which can be attached onto the stem to allow the user to inflate the bag. In many cases the inflation head or nozzle has a system for attachment to the valve stem so that it remains in place during the inflation without necessity for the user to hold it in place.

Examples of a valve and inflation device of this type are shown in U.S. Pat. No. 5,839,488 (Peters) and U.S. Pat. No. 5,082,244 (Krier). The arrangement of Krier requires pushing of the nozzle onto the valve stem, which may be difficult if the portion of the bag where the valve is located has nothing suitable behind it against which to receive the pushing forces.

Another example of a valve of this type which uses a bayonet type fitting is shown in U.S. Pat. No. 5,111,838 (Langston). In this arrangement also it is necessary to push the inflation head onto the valve in order to depress the valve member against its spring bias.

These arrangements are therefore not properly designed in order to allow the user to readily fit the inflation head onto the valve.

Also the above designs are arranged simply for inflation of the bag with the intention that the bag will be slit open. This arrangement does not therefore allow a pre-testing of the bag or a reuse of the bag since the bag can not be rapidly deflated.

In U.S. Pat. No. 5,275,197 (Finell) is disclosed an arrangement in which the bag can be rapidly deflated by removing or loosening a cap on a relatively wide valve stem so that the air can rapidly escape through the valve stem and through holes provided in the cap. In this arrangement the valve itself is mounted in the cap and comprises a simple split tube which is located at the centre of the cap. Filling is effected by an injection nozzle which is inserted through the tube and opens the split part of the tube to allow the air to enter. When the nozzle is removed the two split parts are compressed together by the air pressure thus preventing air release. However this type of valve is very crude and can lose air. Also the user has to push the nozzle or tip into the valve thus requiring a significant pushing force against the valve.

SUMMARY OF THE INVENTION

It is one object of the present invention to provide an improved valve for use in controlling inflation of a bag.

According to a first aspect of the invention there is provided an inflation/deflation valve for filling a bag with air comprising:

a sleeve for insertion into an opening in a wall of a bag to be inflated;

the sleeve being at least partly open therethrough defining a channel through which inflation air can pass from an outer end through an inner end into the bag and through which deflation air can pass from the inner end through the outer end from the bag;

co-operating mounting members for engaging inner and outer surfaces of the wall of the bag to locate the sleeve in the opening;

a valve having a valve seat, a valve member moveable generally axially of the sleeve from a closed position sealing against the seat to an open position lifted away from the seat and a spring biasing the movement of the valve member in the axial direction toward the valve seat;

a cap for closing the sleeve;

the cap and sleeve having co-operating threaded engagements thereon by which the cap can be engaged onto the sleeve and by which the cap can be removed from the sleeve for allowing escape of the deflation air;

the cap having an opening therein through which the inflation air can pass;

the valve being mounted in the opening in the cap so as to removable with the cap;

the cap having mounting elements thereon arranged for engagement with co-operating elements of an inflation head by which the inflation head is in use attached to the cap for supply of inflation air;

the valve member having an abutment surface thereof exposed for engagement with an abutment member of the inflation head by which the valve member is moved axially from the valve seat against the spring bias for passage through the cap of the inflation air.

Preferably the mounting elements of the cap and the co-operating elements of the head define a bayonet fitting.

Preferably the bayonet fitting is defined by radially extending, angularly spaced lugs of the cap which are arranged to co-operate with slots on the head. However the lugs may be provided on the head and the slots in the cap, but this is less preferred.

Preferably the lugs are located at a base of the cap adjacent the wall of the bag so that they are molded integrally as part of a bottom flange.

Preferably an end face of the valve member is located at an outer face of the cap for engaging a projecting member on the head for movement axially of the sleeve under pressure from the projecting member of the head as it is attached onto the cap.

Preferably there is provided a snap on cover for the cap, when the head is removed, the cover having a strap attached to the sleeve for holding the cap attached to the sleeve when unthreaded therefrom.

Preferably the cap includes an end wall and a cylindrical wall for surrounding the sleeve, wherein the end wall has an annular shoulder thereon spaced radially inwardly from the cylindrical wall and wherein the snap on cover has a lip engaging over the annular shoulder.

Preferably the co-operating mounting members which attach the sleeve to the wall of the bag comprise a mounting flange attached to the sleeve at an inner end of the sleeve for engaging an inner surface of the wall and a separate locating ring for mounting on the sleeve for engaging an outer surface of the wall such that the sleeve is held in place in the opening by the mounting flange and the locating ring, wherein the ring and the sleeve have a plurality of locating positions so as to define a plurality of different spaces between the flange and the ring for receiving different thicknesses of wall. The ring is preferably attached to the strap of the cover to hold the cap in place. In order to provided these different locations, which may be three positions, preferably the ring and the sleeve define a plurality of axially spaced inter-engaging snap rings.

According to a second aspect of the invention there is provided an inflation/deflation valve for filling a bag with air comprising:

a sleeve for insertion into an opening in a wall of a bag to be inflated;

the sleeve being at least partly open therethrough defining a channel through which inflation air can pass from an outer end through an inner end into the bag and through which deflation air can pass from the inner end through the outer end from the bag;

a valve arranged to be operable for allowing inflation and deflation of the bag through the sleeve;

and co-operating mounting members for engaging inner and outer surfaces of the wall of the bag to locate the sleeve in the opening;

wherein the co-operating mounting members comprise a mounting flange attached to the sleeve at an inner end of the sleeve for engaging an inner surface of the wall and a separate locating ring for mounting on the sleeve for engaging an outer surface of the wall such that the sleeve is held in place in the opening by the mounting flange and the locating ring, wherein the ring and the sleeve have a plurality of locating positions so as to define a plurality of different spaces between the flange and the ring for receiving different thicknesses of wall.

The valve in this aspect of the invention may or may not include the separate cap, since the main feature of this aspect relates to the co-operation between the mounting flange and the ring to provide the effective adjustable location of the bag wall. If no cap is provided, the inflation head may be arranged to cooperate directly with elements on the sleeve wall.

In order to provide the different spaces, which may be three spaces, the ring and the sleeve preferably define a plurality of axially spaced inter-engaging snap rings.

According to a third aspect of the invention there is provided an inflation/deflation valve for filling a bag with air comprising:

a sleeve for insertion into an opening in a wall of a bag to be inflated;

the sleeve being at least partly open therethrough defining a channel through which inflation air can pass from an outer end through an inner end into the bag and through which deflation air can pass from the inner end through the outer end from the bag;

co-operating mounting members for engaging inner and outer surfaces of the wall of the bag to locate the sleeve in the opening;

a cap for closing the sleeve;

the cap and sleeve having cooperating threaded engagements thereon by which the cap can be engaged onto the sleeve and by which the cap can be removed from the sleeve for allowing escape of the deflation air;

the cap having an opening therein through which the inflation air can pass;

a valve mounted in the opening in the cap so as to removable with the cap, the valve being operable to allow passage of inflation air for filling the bag;

the cap having thereon a plurality of radially extending, angularly spaced lugs.

According to a fourth aspect of the invention there is provided a combination of an inflation/deflation valve with and inflation head for filling a bag with air wherein:

the valve is arranged for insertion into an opening in a wall of a bag to be inflated and being at least partly open therethrough defining a channel through which inflation air can pass from an outer end through an inner end into the bag and through which deflation air can pass from the inner end through the outer end from the bag;

the valve includes co-operating mounting members for engaging inner and outer surfaces of the wall of the bag to locate the valve in the opening;

the valve has a valve seat, a valve member moveable generally axially of the sleeve from a closed position sealing against the seat to an open position lifted away from the seat and a spring biasing the movement of the valve member in the axial direction toward the valve seat;

and the inflation head includes a collar portion for surrounding the valve and a connection to a source of inflation air;

the valve has mounting elements thereon arranged for engagement with co-operating elements of the inflation head by which the collar portion of the inflation head is in use attached to the valve for supply of inflation air;

the valve member has an abutment surface thereof exposed for engagement with an abutment member of the inflation head by which the valve member is moved axially from the valve seat against the spring bias for passage through the cap of the inflation air;

the mounting elements of the valve and the co-operating elements of the head comprise lugs on one of the valve and the head and slots on the other of the valve and head together defining a bayonet fitting;

and the slots are shaped with an axial section within which the lugs move axially and an inclined helical section within which the lugs are rotated while the lugs are moved axially by a camming action as the lugs are rotated, the axial section and the helical section being arranged so that the spring remains uncompressed as the lugs move in the axial section and the spring is compressed substantially wholly by rotation of the lugs in the helical section.

In this arrangement it is preferred that the bayonet fitting is provided by radially extending, angularly spaced lugs on the valve which are arranged to cooperate with slots on the head.

The valve in this aspect of the invention may or may not include the separate cap, since the main feature of this aspect relates to the co-operation between the mounting flange and the ring to provide the effective adjustable location of the bag wall. If no cap is provided, the inflation head may be arranged to cooperate directly with elements on the sleeve wall.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
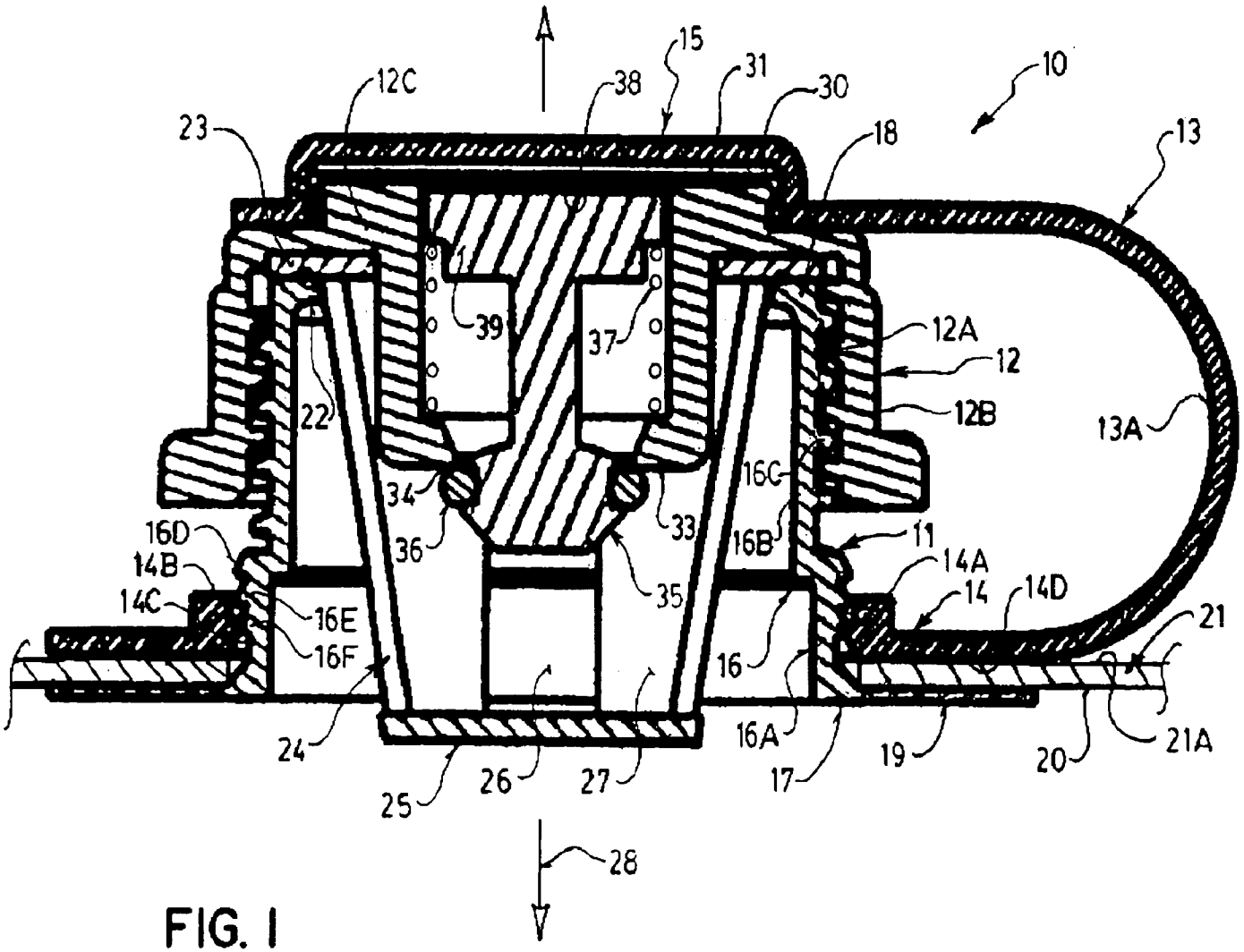
FIG. 1 is a vertical cross sectional view through the wall of a bag showing the valve according to the present invention in a closed position after inflation of the bag.

In FIG. 1 is shown a valve 10 including a valve stem 11, a cap 12 and a third element 13 including a locating ring 14 and a snap cover 15.

The valve stem comprises a generally cylindrical portion 16 which extends from an inner end 17 to an outer end 18. At the inner end 17 is provided a mounting flange 19 which surrounds the end 17 and is arranged to contact the inside surface 20 of the bag wall 21. At the end 18 there is the interned flange 22 which defines an end face for butting against a sealing ring 23 held between the valve stem and the cap 12. The cylindrical wall 16 includes a bottom portion 16A of larger diameter at an upper portion 16B of smaller diameter. The upper portions 16*b* has an external screw thread 16C for co-operation with an internal screw thread 12*a* of the cap 12 and particularly of a cylindrical wall 12B of the cap. The cylindrical wall or collar portion 12B of the cap thus surrounds the upper cylindrical portion 16B of the valve stem and can be threadedly engaged onto the valve stem by rotation of the cap to screw the cap down onto the valve stem so that an end wall 12C of the cap engages against the sealing ring 23 to provide a sealing action between the end wall 12C and the flange 22.

The valve stem further carries an inwardly projecting cradle portion 24 with a flat base 25 located in a plane just below the plane of the mounting flange 19. The base 25 is carried on a plurality of legs of the cradle leaving openings 26 between the legs 27 so that air entering the centre of the valve stem can pass along the axis 28 of the valve stem in an inflation or deflation direction as required.

The locating ring 14 co-operates with the lower portion 16A of the cylindrical wall of the valve stem. The lower portion has on its outer surface three annular rings 16D, 16E, and 16F at axially spaced positions surrounding the portion 16A. The locating ring 14 has an inner ring portion 14A which has on its inside surface 2 annular rings 14B and 14C arranged so as to receive a respective one of the rings 16F, 16E, and 16D therebetween to locate the portion 14A at a required axial position along the portion 16*a* of the cylindrical portion of the valve stem.

Thus the ring 14 defines a bottom surface 14D which contacts the outer surface 21A of the bag wall so that the bag wall is squeezed between the upper surface of the mounting flange 19 and the lower surface 14D of the locating ring 14.

Different thicknesses of wall 21 can thus be accommodated by moving the portion 14A to one of three separate locations including a lowest location in which the recess between the rings 14B and 14C is located on the ring 16F, an intermediate position in which the recess is located on the ring 16E as an outermost location in which the recess is located on the ring 16D. These three positions thus accommodate three different thicknesses of wall depending upon the material from which the wall is fabricated. The wall is of course fabricated from various different types of materials as is well known to one skilled in the art generally including an air impermeable linear.

The ring 14 is attached to a strap 13A which connects the ring 14 to the cover 15.

The end wall 12C of the cap is shaped to form an annular shoulder 30 on the cap surrounding a flat top surface 31 of the cap. The shoulder 30 cooperates with a shallow recess in the cover 15 so the cover 15 simply covers the flat top 31 with edges of the recess engaging into the area behind the shoulder 30 to hold the cover on the cap. The cover is intended simply to prevent inadvertent operation of the valve so the cover simply snaps into place over the top face 31 of the cap.

The cap includes a central recess portion 32 which extends downwardly from the top surface 31 into the valve stem with an interned flange section 33 at the bottom of the cylindrical section 32 defining a valve seat 34 for a valve member 35. The valve member includes an annular O-ring 36 which engages against the valve seat 34 when the valve member is biased upwardly by a spring 37. In the upward closed position where the O-ring 36 is against the valve seat, a top surface 38 of the valve member lies co-planar with the top surface 31 of the cap. The top surface 38 is mounted on an upper portion 39 of the valve member which is cross shaped so as to define openings through which air can pass so as to extend along the inside of the cylindrical portion 32 to the valve seat to bypass the valve member for entry into the bag for inflation when the valve member is depressed. Thus the valve member is movable from the raised closed position by a downward force on the valve member pressing against the top surface 38 of the cross shaped upper portion 39 thus pushing the O-ring away from the valve seat and allowing air to enter.

The valve can be opened for discharge of air for deflation by unscrewing the cap from the valve stem and removing the cap with the valve member attached from the valve stem allowing air to escape through the cradle 24 and through the open upper end of the valve stem thus allowing the bag to deflate rapidly through the relatively large opening defined by the valve stem.

Figure 2:
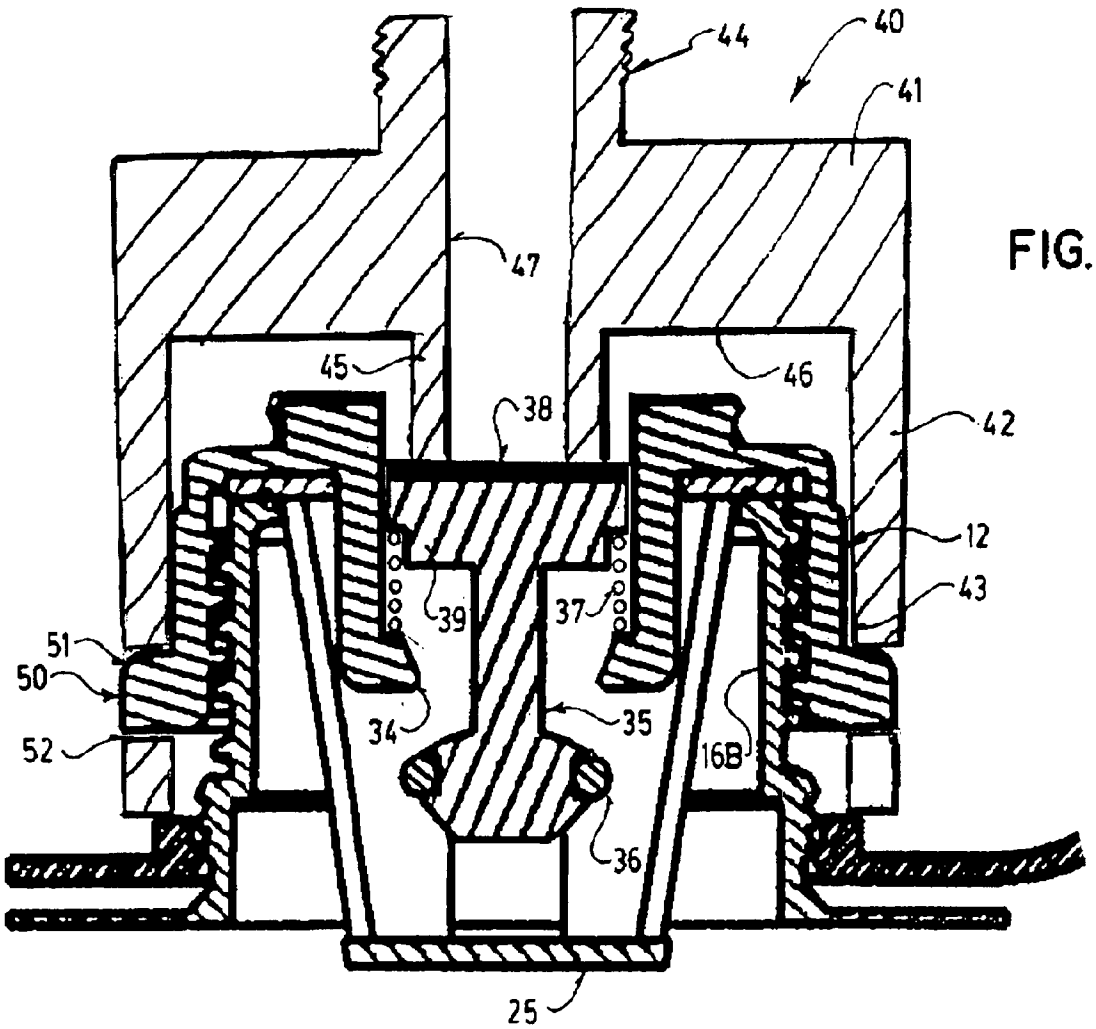
FIG. 2 is a cross sectional view of the similar to that of FIG. 1 showing the valve with the inflation head attached.
Figure 3:
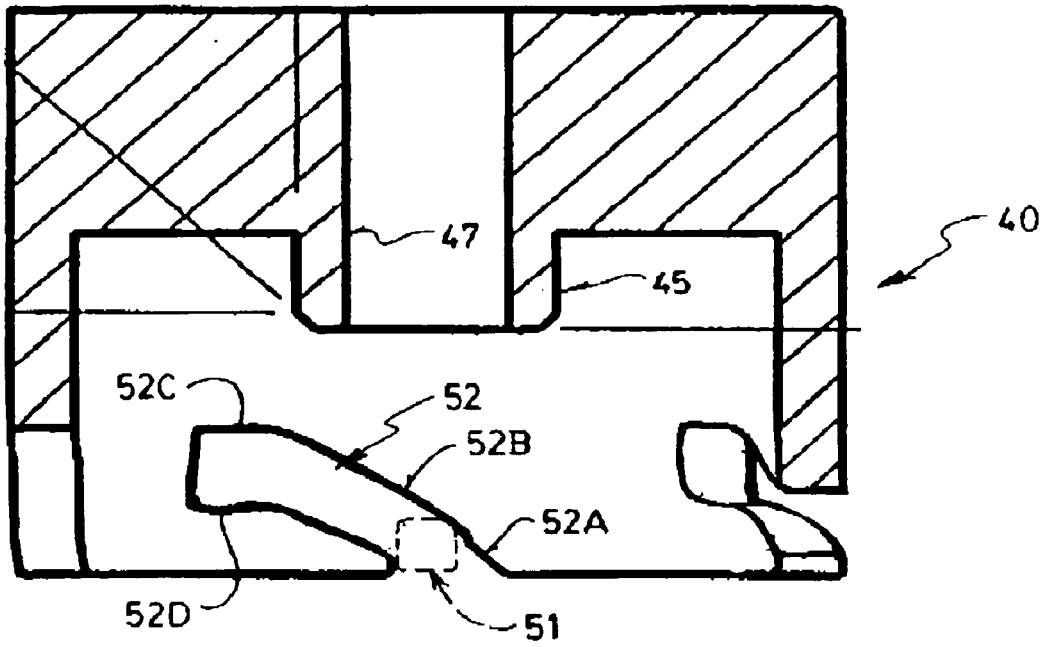
FIG. 3 is a cross sectional view of the inflation head of FIG. 2 showing the shape of the drive slots.
Figure 4:
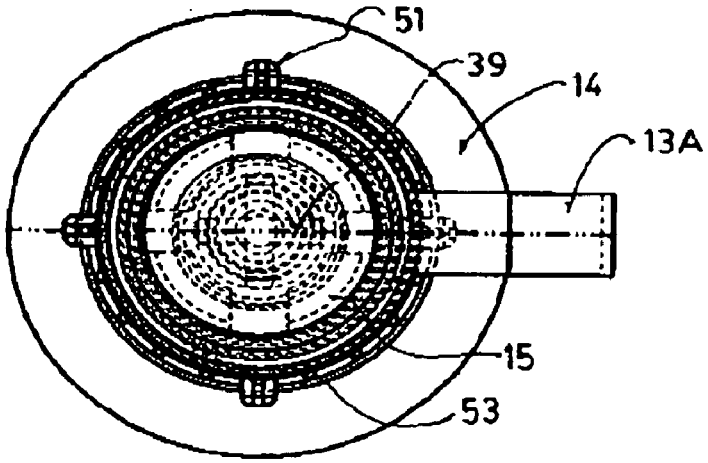
FIG. 4 is a top plan view of the valve of FIG. 1.
Figure 5:
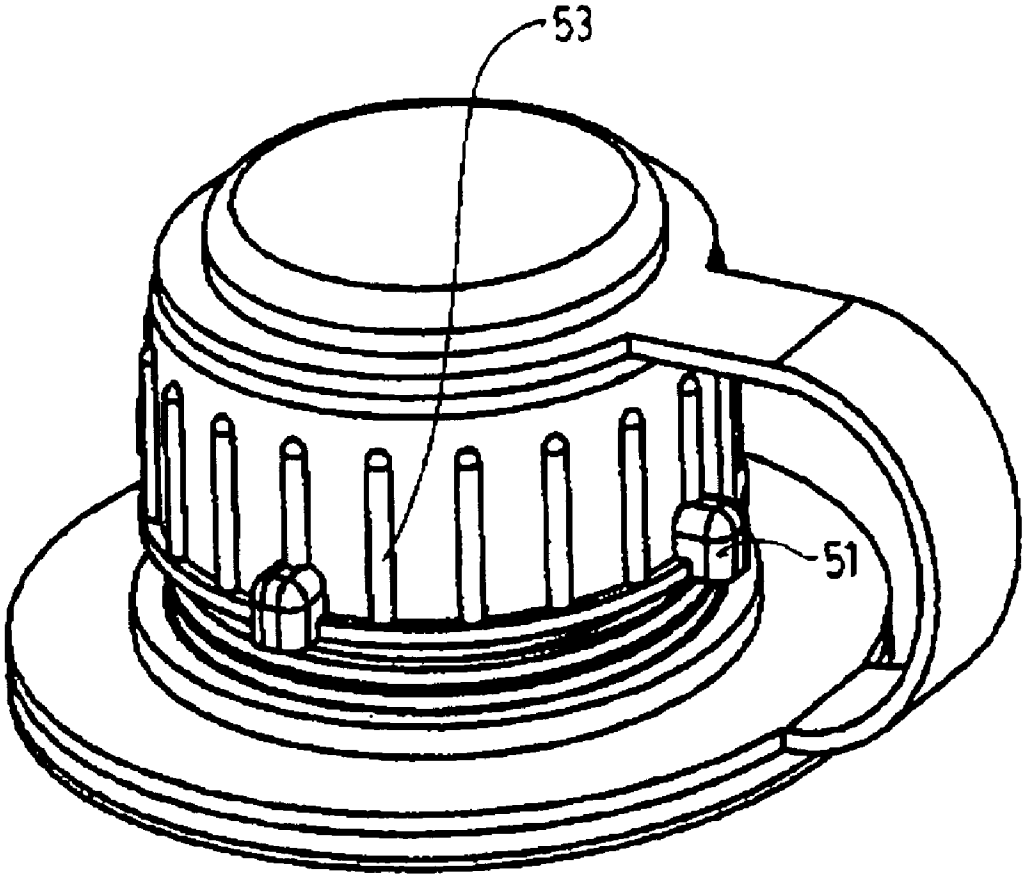
FIG. 5 is an isometric view of the valve of FIG. 1.

The valve co-operates with an inflation head 40 as best shown in FIGS. 2 and 3. The inflation head comprises a base 41 and a cylindrical collar 42 attached to the base and extending therefrom toward the cap 12 so as to surround the cap with an inside surface 43 of the collar immediately adjacent the outside surface of the cylindrical portion 16B of the cap. The inflation head further includes a coupling 44 for attachment to a supply house (not shown) of an air source. The inflation head further includes a projecting portion 45 which extends downwardly from a bottom surface 46 of the base 41 at the centre of the base so as to engage the upper surface 38 of the valve member 35. A bore 47 extends through the coupling 44, through the base 41 and through the projecting portion 45 so as to communicate air from the source attached to the coupling 44 through the cross shaped upper portion 39 of the valve member and passed the valve seat for inflation. The attached position is shown in FIG. 2 where the projecting portion 45 depresses the valve member against the bias of the springs 37.

In order to attach the inflation head 40 to the cap 12, there is provided a bayonet fitting 50 defined by four lugs 51 on the cap 12 at four slots 52 on the inflation head 40. The lugs 51 are arranged at angularly spaced positions around the cap. The lugs are formed integrally with a base of the cap so that the lugs are arranged on the cylindrical wall of the cap adjacent to the wall of the bag, thus leaving an outer portion of the cylindrical wall of the cap with ribs 53 by which the cap may be grasped manually for engagement onto and release from the valve stem by the threaded action.

The lugs 51 are shaped to engage into the slots and to move the longer slots in a camming action. The slots are shaped as shown in FIG. 3 to provide a first portion 52A, a second portion 52B and an end portion 52C.

The first portion 52A is arranged so that the lugs 51 can be engaged into the first portion 52A simply by locating the head onto the cap without compressing the valve member 35. Thus when the lugs 51 are received into the first portion 52A, the bottom surface of the projecting portion 45 just comes into contact with the top surface 38 of the valve member.

The second section 52 is arranged in a helical direction so that the lug located in the slot is moved axially by a camming action within the second portion 52B as the head is rotated on the cap. Thus there is no need for the user to push against the head and against the valve since the rotation of the head on the lugs pulls the head downwardly onto the valve by the camming action and thus presses the projecting portion 45 onto the valve member against the action of the spring 37. Thus the whole of the movement of the valve member against the biasing action of the spring is effected simply by rotation without any pushing force necessary.

The third portion 52C includes a bottom surface 52D which is slightly recessed to receive the lug 51 and hold the lug in the rotated position of the head due to the action of the spring 37 which pushes the head away from the valve and thus locates the lug within the slightly recessed bottom portion 52D.

In this way the head is held in place and it is not necessary for the user to retain any grip on the head since it has no tendency to move from its attached position compressing the valve member. Air injected through the bore 47 thus enters passed the valve member into the valve stem and inflates the bag. The base plate 25 presses against an opposite wall of the bag so as to hold that opposite wall away from the wall 21 to allow inflation air to pass between the two walls and start inflating the bag. Also the base plate 25 prevents air from being injected vigorously through the bore 47 in a manner which could damage the opposite wall of the bag and potentially cause a puncture. Thus the plate 25 deflects and diffuses the air allowing the bag to start inflating without damage to the bag in the initial inflation movement.

When inflation is complete, the inflation head is removed by rotation in the direction opposite to the attachment direction thus releasing the lugs from the slots 52 and allowing the head to be pulled away from the cap after the lugs moved back to the initial position 52A.

The amount of force necessary for rotation of the head on the cap is relatively low so that there is little danger of rotating the cap. However if preferred, the rotation direction necessary for attaching the cap may be opposite to the direction necessary for removing the cap to avoid the cap being loosened.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. An inflation/deflation valve for filling a bag with air comprising:

a sleeve for insertion into an opening in a wall of a bag to be inflated;

the sleeve being at least partly open therethrough defining a channel through which inflation air can pass from an outer end through an inner end into the bag and through which deflation air can pass from the inner end through the outer end from the bag;

a mounting flange on the sleeve for engaging an inner surface of the wall of the bag;

a separate locating ring for mounting on the sleeve and surrounding the sleeve for engaging an outer surface of the wall such that the sleeve is held in place in the opening by the mounting flange and the locating ring;

a cap for closing the sleeve having an outer end wall arranged to be exposed outside the bag at an end of the sleeve and a generally cylindrical wall surrounding the sleeve;

the cylindrical wall of the cap having a female thread therein and the sleeve having a cooperating male thread thereon by which the cap can be engaged onto the sleeve and by which the cap can be removed from the sleeve for allowing escape of the deflation air;

the cap having an opening extending axially therethrough through which the inflation air can pass;

a valve mounted in the opening in the cap so as to removable with the cap;

the cylindrical wall of the cap having mounting elements thereon arranged for engagement with co-operating elements of an inflation head by which the inflation head is in use attached to the cap so as to be located at the outer end thereof for supply of inflation air from the outer end through the opening of the cap into the bag;

the valve having a valve seat on the cap, a valve member moveable generally axially of the cap from a closed position sealing against the seat on the cap to an open position pushed away from the seat and a spring biasing the movement of the valve member in the axial direction towards the valve seat;

the valve member having an abutment surface thereof exposed in the opening of the cap at the outer end of the cap for engagement with an abutment member of the inflation head by which the valve member is pushed axially from the valve seat against the spring bias for passage through the cap of the inflation air.

2. The valve according to claim 1 wherein the mounting elements of the cap and the co-operating elements of the head define a bayonet fitting.

3. The valve according to claim 1 wherein the mounting elements of the cap comprise radially extending, angularly spaced lugs of the cap which are arranged to cooperate with slots on the head in a bayonet fitting.

4. The valve according to claim 3 wherein the lugs are located at a base of the cap adjacent the wall of the bag.

5. The valve according to claim 1 wherein an end face of the valve member is located at an outer face of the cap for engaging a projecting member on the head.

6. The valve according to claim 1 wherein there is provided a snap on cover for the cap, when the head is removed, the cover having a strap attached to the sleeve for holding the cap attached to the sleeve when unthreaded therefrom.

7. The valve according to claim 6 wherein the cap includes an end wall and a cylindrical wall for surrounding the sleeve, wherein the end wall has an annular shoulder thereon spaced radially inwardly from the cylindrical wall and wherein the snap on cover has a lip engaging over the annular shoulder.

8. The valve according to claim 1 wherein the locating ring and the sleeve have a plurality of radially extending, axially spaced, inter-engaging annular snap rings so as to define a plurality of different spaces between the flange and the ring for receiving different thicknesses of wall and wherein the snap rings on the sleeve are provided on a first portion of the sleeve which axially spaced and separate from a second portion carrying the male thread thereon with the first portion being of larger diameter than the second portion.

9. The valve according to claim 8 wherein the locating ring and the sleeve define at least three positions.

10. The valve according to claim 1 wherein there is provided a snap on cover, the cover having a strap attached to the locating ring.

11. An inflation/deflation valve for filling a bag with air comprising:

a sleeve for insertion into an opening in a wall of a bag to be inflated;

the sleeve being at least partly open therethrough defining a channel through which inflation air can pass from an outer end through an inner end into the bag and through which deflation air can pass from the inner end through the outer end from the bag;

a cap for closing the sleeve having an outer end wall arranged to be exposed outside the bag at an end of the sleeve and a generally cylindrical wall surrounding the sleeve;

the cylindrical wall of the cap having a female thread therein and the sleeve having a cooperating male thread thereon by which the cap can be engaged onto the sleeve and by which the cap can be removed from the sleeve;

a valve arranged to be operable for allowing inflation and deflation of the bag through the sleeve;

and co-operating mounting members for engaging inner and outer surfaces of the wall of the bag to locate the sleeve in the opening;

wherein the co-operating mounting members comprise a mounting flange attached to the sleeve at an inner end of the sleeve for engaging an inner surface of the wall and a separate locating ring for mounting on the sleeve for engaging an outer surface of the wall such that the sleeve is held in place in the opening by the mounting flange and the locating ring, wherein the locating ring and the sleeve have a plurality of radially extending, axially spaced, inter-engaging annular snap ring so as to define a plurality of different spaces between the flange and the ring for receiving different thicknesses of wall and wherein the snap rings on the sleeve are provided on a first portion of the sleeve which is axially spaced and separate from a second portion carrying the male thread thereon with the first portion being of larger diameter than the second portion.

12. The valve according to claim 11 wherein the locating ring and the sleeve define at least three positions.

13. An inflation/deflation valve and inflation head for filling a bag with air comprising:

the valve being arranged for insertion into an opening in wall of a bag to be inflated and being at least partly open therethrough defining a channel through which inflation air can pass from an outer end through an inner end into the bag and through which deflation air can pass from the inner end through the outer end from the bag;

the valve including co-operating mounting members for engaging inner and outer surfaces of the wall of the bag to locate the valve in the opening;

the valve having a valve seat, a valve member moveable generally axially of the sleeve from a closed position sealing against the seat to an open position lifted away from the seat and a spring biasing the movement of the valve member in the axial direction toward the valve seat;

the inflation head including a collar portion for surrounding the valve and a connection to a source of inflation air;

the valve having mounting elements thereon arranged for engagement with cooperating elements of the inflation head by which the collar portion of the inflation head is in use attached to the valve for supply of inflation air;

the valve member having an abutment surface thereof exposed for engagement with an abutment member of the inflation head by which the valve member is moved axially from the valve seat against the spring bias for passage through the cap of the inflation air;

wherein the mounting elements of the valve and the co-operating elements of the head comprise tugs on one of the valve and the head and slots on the other of the valve and head together defining a bayonet fitting;

wherein the slots are shaped with an axial section within which the lugs move axially and an inclined helical section within which the lugs are rotated while the lugs are moved axially by a camming action as the lugs are rotated, the axial section and the helical section being arranged so that the spring remains un-compressed as the lugs move in the axial section and the spring is compressed substantially wholly by rotation of the lugs in the helical section.

14. The valve and head according to claim 13 wherein the mounting elements of the valve comprise radially extending, angularly spaced lugs of the valve which are arranged to co-operate with slots on the head in the bayonet fitting.

15. The valve and head according to claim 14 wherein the lugs are located at a base of the cap adjacent the wall of the bag.

16. The valve and head according to claim 13 wherein an end face of the valve member is located at an outer face of the valve for engaging a projecting member on the head.

* * * * *